US010151323B2

(12) United States Patent
Chia

(10) Patent No.: US 10,151,323 B2
(45) Date of Patent: Dec. 11, 2018

(54) CEILING FAN CAPABLE OF ADJUSTING ANGLES OF FAN BLADES

(71) Applicant: Eten Technology Ltd, British Columbia (CA)

(72) Inventor: Hui-Tsu Chia, British Columbia (CA)

(73) Assignee: Eten Technology Ltd, British Columbia (CA)

( * ) Notice: Subject to any disclaimer, the term of this patent is extended or adjusted under 35 U.S.C. 154(b) by 274 days.

(21) Appl. No.: 15/348,216

(22) Filed: Nov. 10, 2016

(65) Prior Publication Data

US 2018/0128277 A1 May 10, 2018

(51) Int. Cl.
*F04D 29/36* (2006.01)
*F04D 25/08* (2006.01)

(52) U.S. Cl.
CPC ..... *F04D 29/362* (2013.01); *F04D 25/088* (2013.01); *F04D 29/36* (2013.01)

(58) Field of Classification Search
CPC ..... F04D 25/088; F04D 29/362; F04D 25/08; F04D 27/002; F04D 29/364
See application file for complete search history.

(56) References Cited

U.S. PATENT DOCUMENTS 2,956,739 A * 10/1960 Tothill ..... F04D 29/364 416/137
2008/0309086 A1* 12/2008 Takaichi ..... F03D 80/88 290/52
2011/0020135 A1* 1/2011 Itou ..... F04D 25/088 416/244 R
2013/0084180 A1* 4/2013 Conley ..... F04D 29/364 416/1

OTHER PUBLICATIONS

Aircraft Engine Historical Society Inc, 'Hamilton Standard Hydromatic Propeller', pp. 1-5. [Online]: via Wayback Machine, Jun. 17, 2011 <URL:http://www.enginehistory.org/Propellers/HamStd/hamstd.shtml>.*

* cited by examiner

*Primary Examiner* — Kenneth Bomberg
*Assistant Examiner* — Hakeem Abdellaoui
(74) *Attorney, Agent, or Firm* — C. G. Mersereau; Nikolai & Mersereau, P.A.

(57) ABSTRACT

A ceiling fan capable of adjusting angles of fan blades includes a hub, a downrod, a rotating motor selectively driving the hub to rotate relative to the downrod, multiple blade assemblies separately mounted on and arranged around the hub, and an adjusting assembly mounted in the hub and including an outer tube, an inner tube, a support, and a driving motor. A driving rod of each of the blade assemblies is mounted in a driving annular recess of the support. When a driving screw of the driving motor rotates, the driving screw drives the outer tube to rotate and drives the inner tube to move upwardly or downwardly accordingly, so as to provide an optimized volume of air current that meets power saving requirement under a constant revolution speed of the rotating motor.

12 Claims, 11 Drawing Sheets

CEILING FAN CAPABLE OF ADJUSTING ANGLES OF FAN BLADES

BACKGROUND OF THE INVENTION

1. Field of the Invention

The present invention relates to a ceiling fan, especially to a ceiling fan that is capable of adjusting angles of fan blades.

2. Description of the Prior Art(S)

A ceiling fan is a mechanical fan suspended from a ceiling of a room and includes a hub, multiple fan blades mounted on and arranged around the hub, and a rotating motor driving the hub as well as the fan blades to rotate. Each of the fan blades tilts relative to a plane that is formed by rotation of the fan blades. Thus, the fan blades push air to form an air current and to circulate air, so as to ventilate the room and dissipate heat around human bodies. Velocity and volume of the air current depend on tilting angles of the fan blades and revolution speed of the driving motor. Under a constant revolution speed, as the tilting angles of the fan blades increase, the volume of the air current and windage on the fan blades increase accordingly and output kinetic energy, and electric power consumption of the driving motor increase consequently.

A conventional ceiling fan that is capable of adjusting angles of fan blades includes a hub with multiple mounting tubes. Each of the mounting tubes of the hub has multiple positioning holes. Each of the fan blades also has a mounting tube disposed on an end of the fan blade. The mounting tube of the fan blade also has multiple positioning holes. The mounting tube of the fan blade is mounted in or sleeved on a corresponding one of the mounting tubes of the hub. A tilting angle of the fan blade relative to the hub can be held by inserting a pin in the positioning holes of the mounting tube of the fan blade and the corresponding one of the mounting tubes of the hub.

However, since the conventional ceiling fan is suspended from the ceiling and the pin should be detached from one fan blade before adjusting the tilting angle of the fan blade, a regular user of the ceiling fan is unable to adjust the tilting angles of the fan blades by himself. The tilting angles of the fan blades are determined upon mounting of the conventional ceiling fan to the ceiling and cannot be adjusted according to revolution speed of a driving motor and the fan blades.

To overcome the shortcomings, the present invention provides a ceiling fan capable of adjusting angles of fan blades to mitigate or obviate the aforementioned problems.

SUMMARY OF THE INVENTION

The main objective of the present invention is to provide a ceiling fan capable of adjusting angles of fan blades. The ceiling fan includes a hub, a downrod, a rotating motor, multiple blade assemblies, and an adjusting assembly. The rotating motor selectively drives the hub to rotate relative to the downrod. The blade assemblies are separately mounted on and arranged around the hub. The adjusting assembly is mounted in the hub and includes an outer tube, an inner tube, a support, and a driving motor. A driving rod of each of the blade assemblies is mounted in a driving annular recess of the support.

When a driving screw of the driving motor rotates, the driving screw drives the outer tube to rotate and drives the inner tube to move upwardly or downwardly accordingly, so as to provide an optimized volume of air current that meets power saving requirement and to make users feel most comfortable under a constant revolution speed of the rotating motor.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
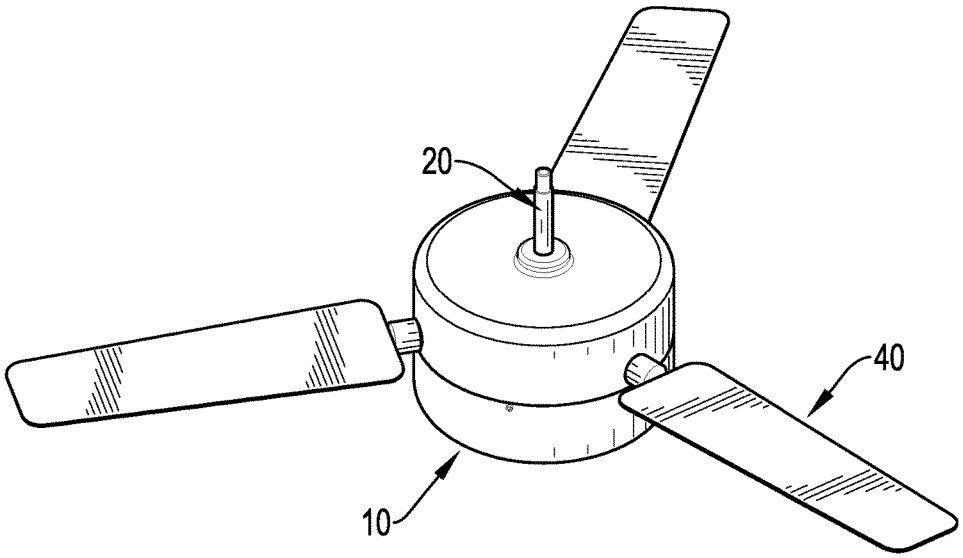
FIG. 1 is a perspective view of a ceiling fan capable of adjusting angles of fan blades in accordance with the present invention.
Figure 2:
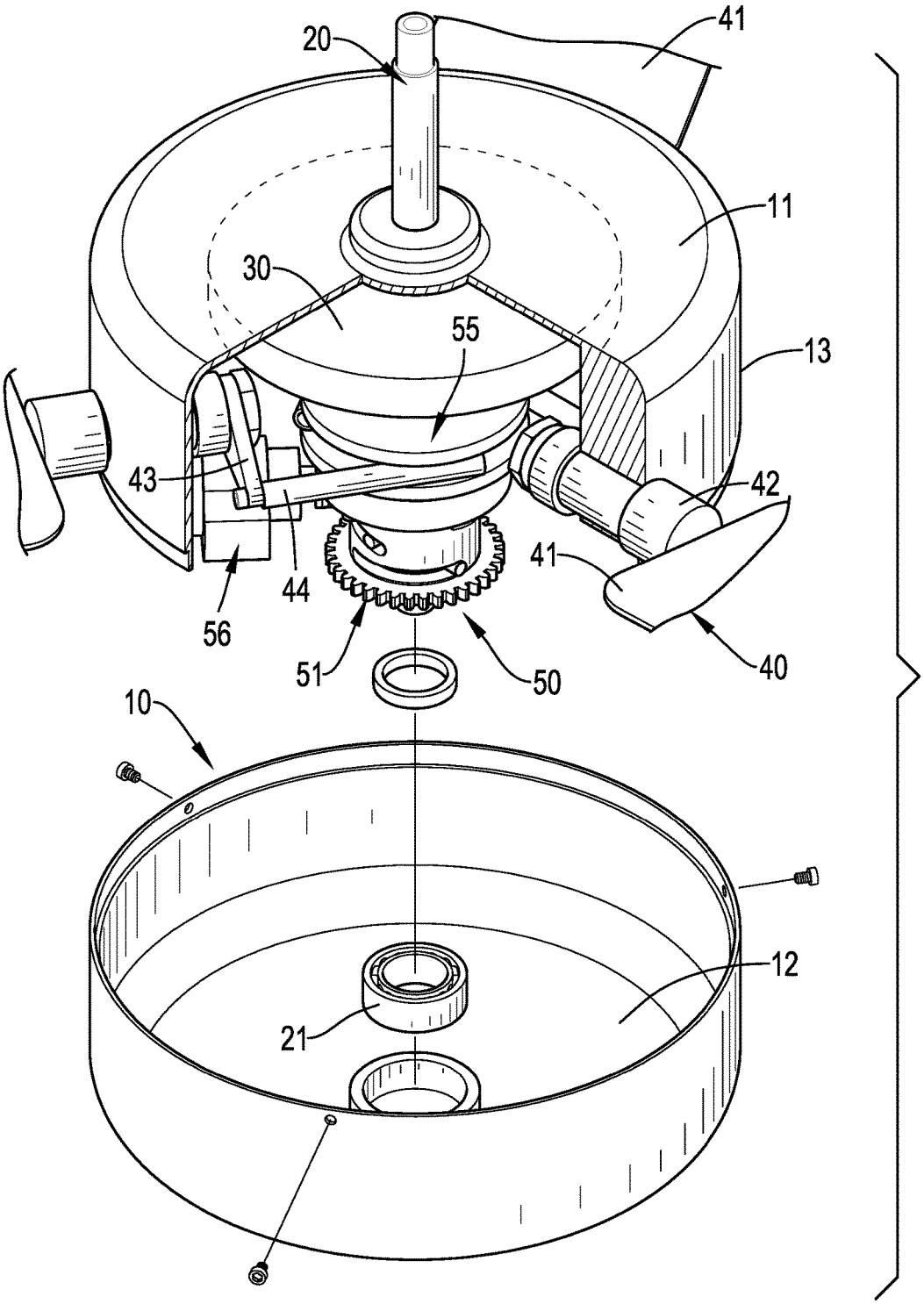
FIG. 2 is an exploded perspective view of the ceiling fan in FIG. 1.

With reference to FIGS. 1 and 2, a ceiling fan in accordance with the present invention comprises a hub 10, a downrod 20, a rotating motor 30, multiple blade assemblies 40, and an adjusting assembly 50.

The hub 10 is hollow and has a top panel 11, a bottom panel 12, and a side panel 13. Specifically, the hub 10 is formed by attaching an upper casing and a lower casing. The upper casing has the top panel 11 and an upper sidewall. The lower casing has the bottom panel 12 and a lower sidewall. The upper sidewall and the lower sidewall are attached to each other to form the side panel 13.

Figure 5:
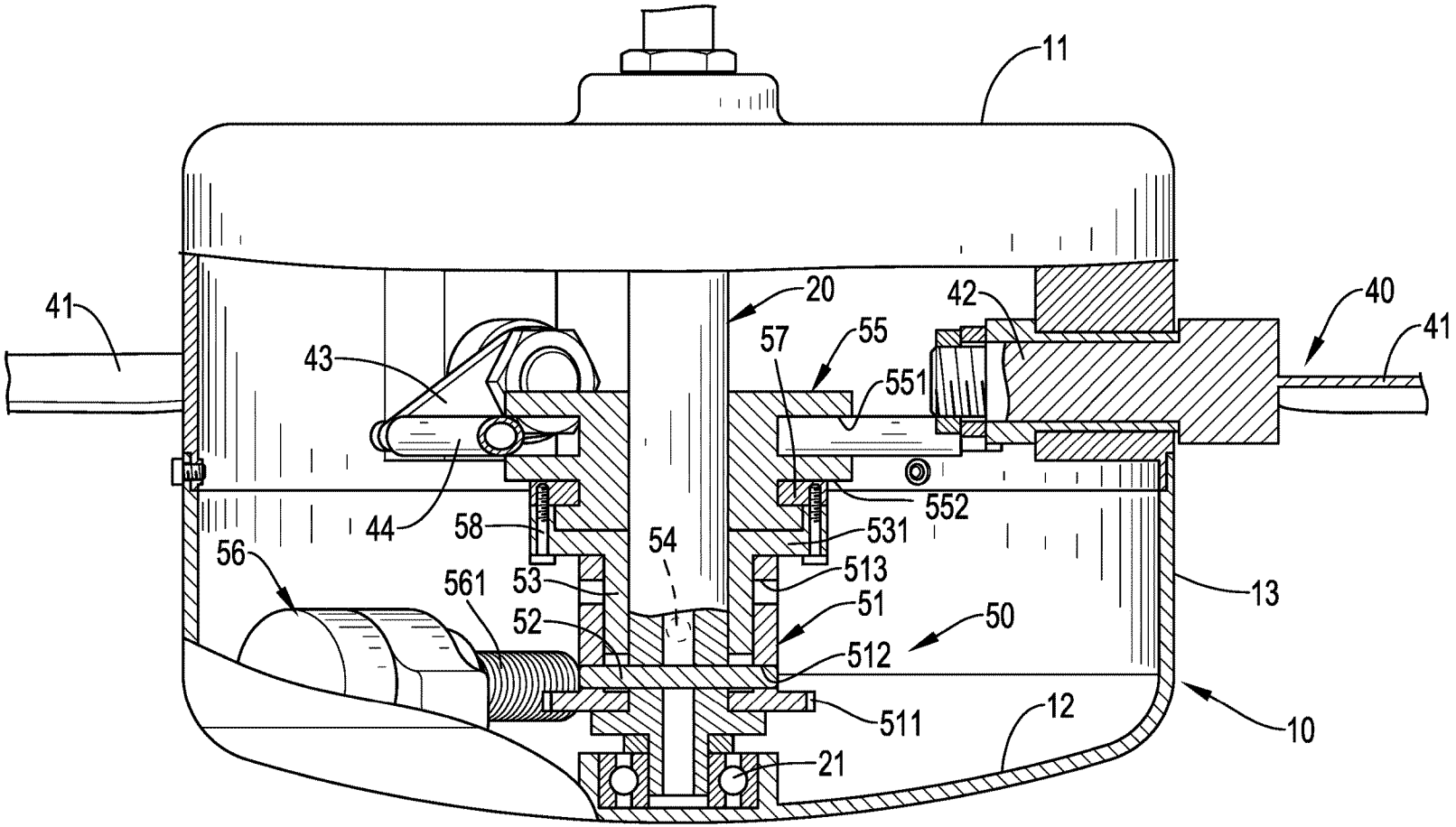
FIG. 5 is an enlarged side view in partial section of the ceiling fan in FIG. 1.

With further reference to FIG. 5, the downrod 20 is vertically mounted through the hub 10 along a rotation axis of the hub 10 and is connected to the top panel 11 and the bottom panel 12 of the hub 10 via rotating bearings 21, such that the hub 10 can rotate relative to the downrod 20. The downrod 20 has a top end used for being fixed to a ceiling, so as to suspend the ceiling fan from the ceiling.

The rotating motor 30 is mounted in the hub 10, is connected to the downrod 20 and the hub 10, and selectively drives the hub 10 to rotate relative to the downrod 20.

Figure 3:
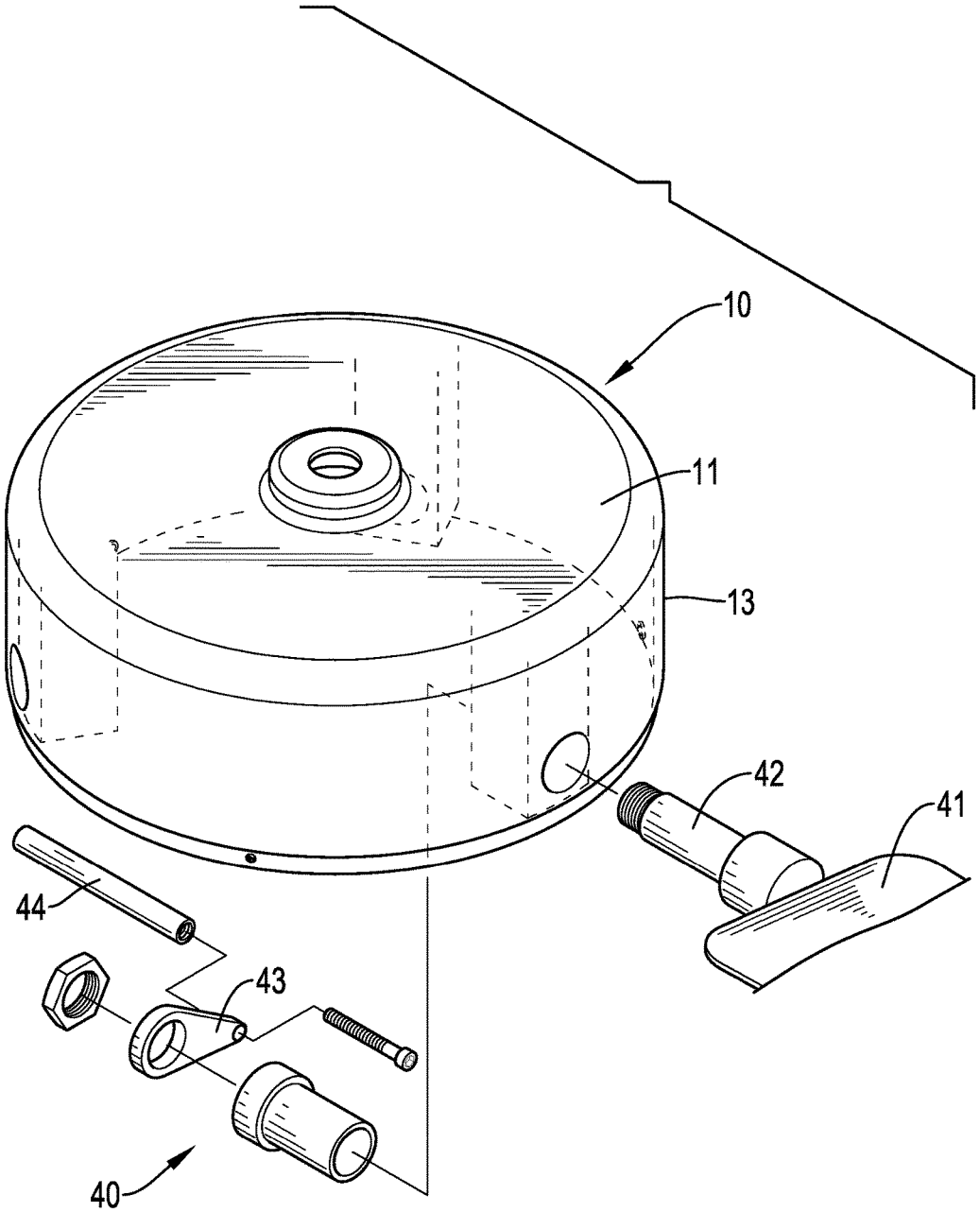
FIG. 3 is an exploded perspective view of a hub and a blade assembly of the ceiling fan in FIG. 1.

With further reference to FIG. 3, the blade assemblies 40 are separately mounted on and arranged around the side panel 13 of the hub 10. Each of the blade assemblies 40 extends along a radial direction of the hub 10. Specifically, the blade assemblies 40 are separately mounted on and arranged around the upper sidewall of the upper casing of the hub 10. Each of the blade assemblies 40 includes a fan blade 41, a pivot shaft 42, a connector 43, and a driving rod 44. The fan blade 41 has an inner end. The inner end of the fan blade 41 is positioned toward the hub 10. The pivot shaft 42 is securely attached to the inner end of the fan blade 41 and is rotatably mounted through the side panel 13 of the hub 10. The pivot shaft 42 has an outer end and an inner end. The outer end of the pivot shaft 42 protrudes to an exterior of the hub 10 and is securely attached to the fan blade 41. The inner end of the pivot shaft 42 protrudes to an interior of the hub 10. The connector 43 is elongated, is mounted in the hub 10, and has a first end and a second end. The first end of the connector 43 is securely connected to the inner end of the pivot shaft 42. The driving rod 44 is mounted in the hub 10, is rotatably connected to the second end of the connector 43, and is parallel to the connector 43.

Figure 4:
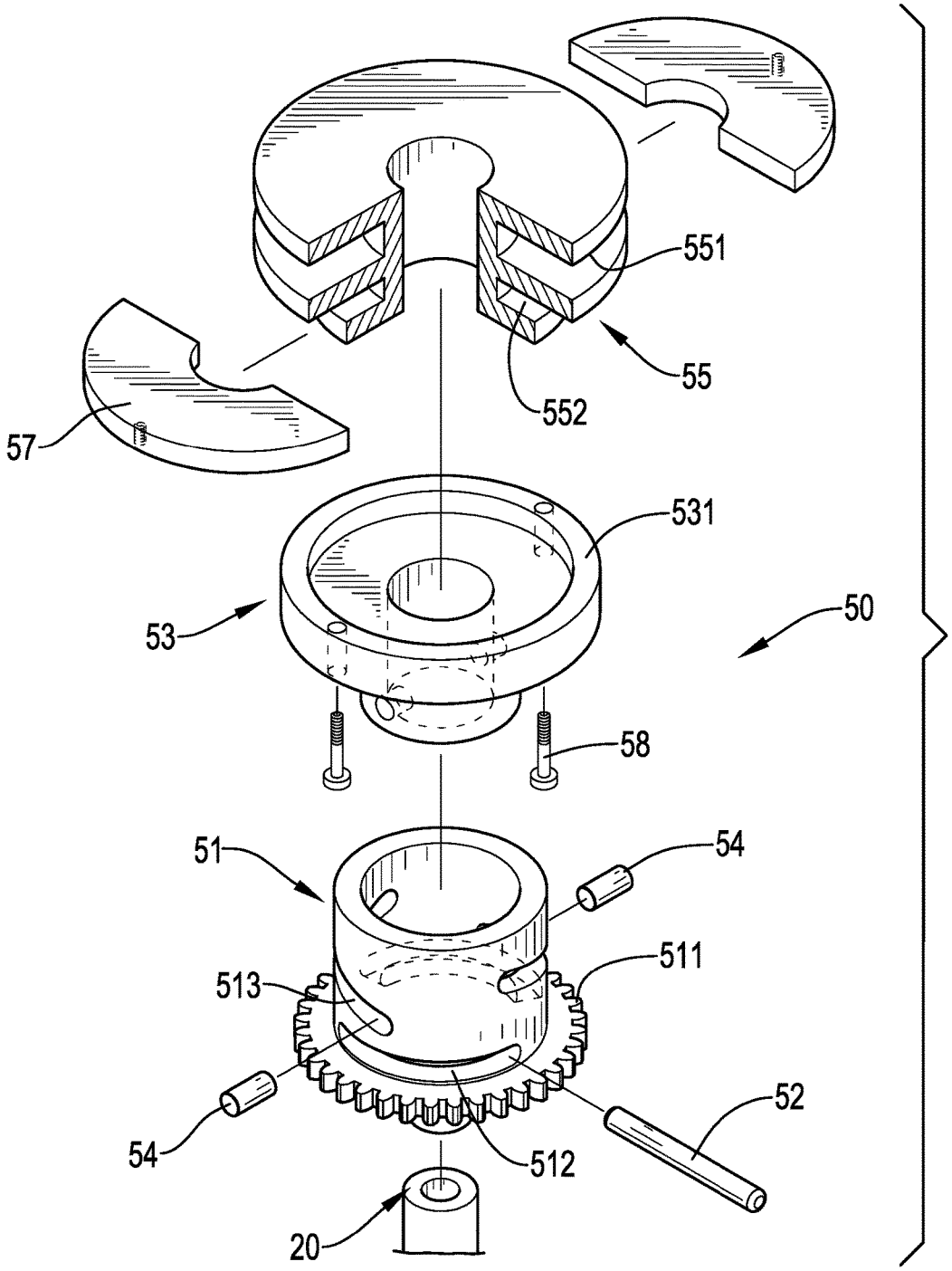
FIG. 4 is an exploded perspective view of a downrod and an adjusting assembly of the ceiling fan in FIG. 1.

With further reference to FIG. 4, the adjusting assembly 50 is mounted in the hub 10 and includes an outer tube 51, at least one limiting rod 52, an inner tube 53, at least one guiding rod 54, a support 55, multiple connecting panels 57, and a driving motor 56.

Figure 6A:
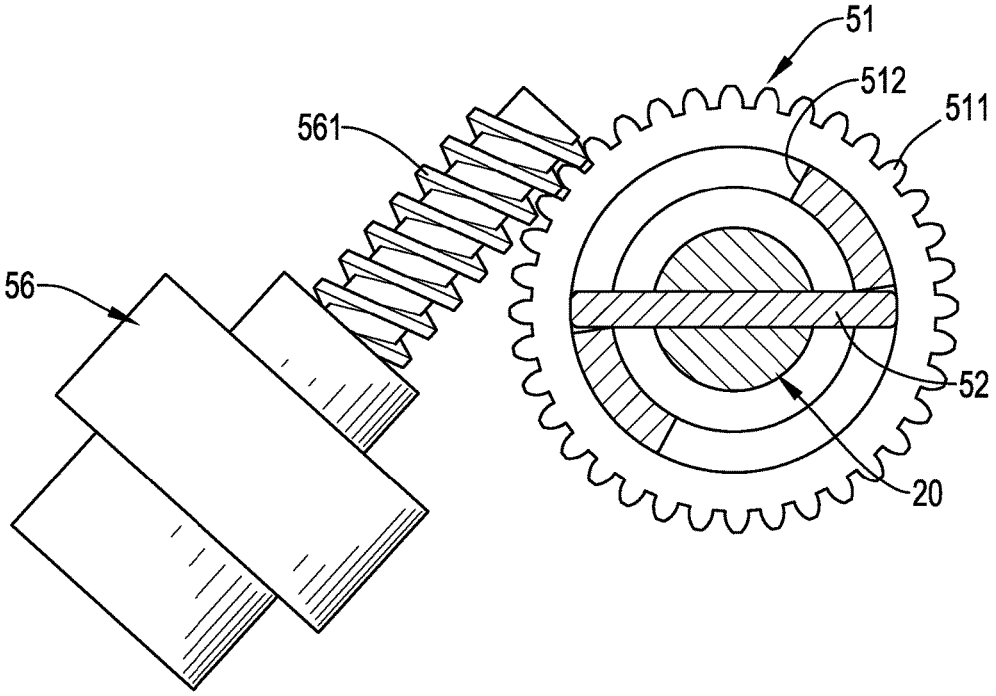
FIG. 6A is a cross-sectional top view of the downrod and the adjusting assembly of the ceiling fan in FIG. 1.
Figure 6B:
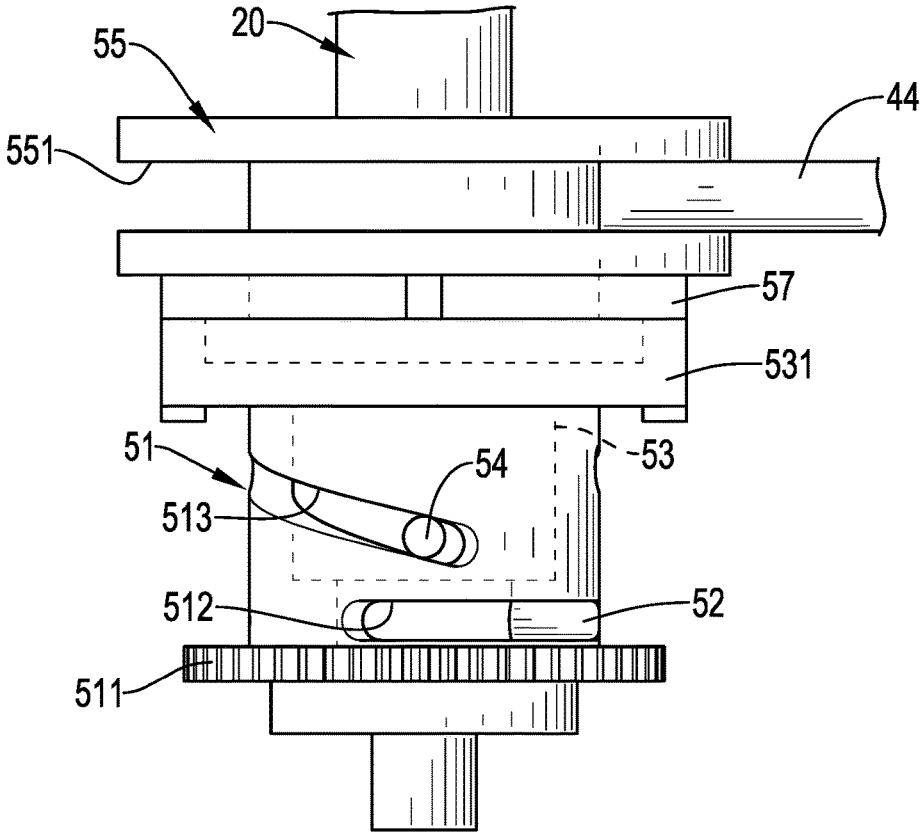
FIG. 6B is an enlarged side view of the downrod, the adjusting assembly, and a driving rod of the blade assembly of the ceiling fan in FIG. 1.

With further reference to FIGS. 6A and 6B, the outer tube 51 is rotatably mounted around the downrod 20 and has a top end, a bottom end, an outer side surface, a ring gear 511, at least one limiting slot 512, and at least one guiding slot 513. The ring gear 511 is formed around the outer side surface of the outer tube 51 and is disposed adjacent to the bottom end of the outer tube 51. The at least one limiting slot 512 is formed through the outer tube 51. Each of the at least one limiting slot 512 extends transversely. The at least one guiding slot 513 is formed through the outer tube 51. Each of the at least one guiding slot 513 extends obliquely and has an upper end and a lower end. The upper end of each of the at least one guiding slot 513 extends toward the top end of the outer tube 51. The lower end of each of the at least one guiding slot 513 extends toward the bottom end of the outer tube 51.

Each of the at least one limiting rod 52 is disposed along a radial direction of the downrod 20, is securely attached to the downrod 20, and has at least one limiting end. Each of the at least one limiting end protrudes in a corresponding one of the at least one limiting slot 512. The at least one limiting rod 52 limits a rotating angle of the outer tube 51 and prevents the outer tube 51 from moving along an axial direction of the downrod 20.

The inner tube 53 is mounted around the downrod 20, is disposed between the downrod 20 and the outer tube 51, and has a top end and a connecting flange 531. The connecting flange 531 is formed around the top end of the inner tube 53 and protrudes along a radial direction of the inner tube 53. Specifically, the connecting flange 531 is L-shaped in cross-section. The connecting flange 531 radially protrudes from the top end of the inner tube 53 and then bends and protrudes upwardly along an axial direction of the inner tube 53.

The at least one guiding rod 54 is disposed along the radial direction of the downrod 20 and is securely attached to the inner tube 53. Each of the at least one guiding rod 54 protrudes in a corresponding one of the at least one guiding slot 513. When the outer tube 51 rotates, the outer tube 51 drives the inner tube 53 to move up or down via the at least one guiding rod 54. As the at least one guiding rod 54 slides toward the upper end of the at least one guiding slot 513, the inner tube 53 moves upwardly and gradually protrudes out from the top end of the outer tube 51.

In the preferred embodiment, the at least one limiting slot 512 includes two limiting slots 512 oppositely disposed on the outer tube 51, the at least one guiding slot 513 includes two guiding slots 513 oppositely disposed on the outer tube 51, the at least one limiting rod 52 includes one limiting rod 52 radially mounted through the downrod 20, the at least one limiting end of the limiting rod 52 includes two limiting ends respectively protruding in the two limiting slots 512, and the at least one guiding rod 54 includes two guiding rods 54 oppositely disposed on the downrod 20 and respectively protruding in the two guiding slots 513 of the outer tube 51.

Figure 6C:
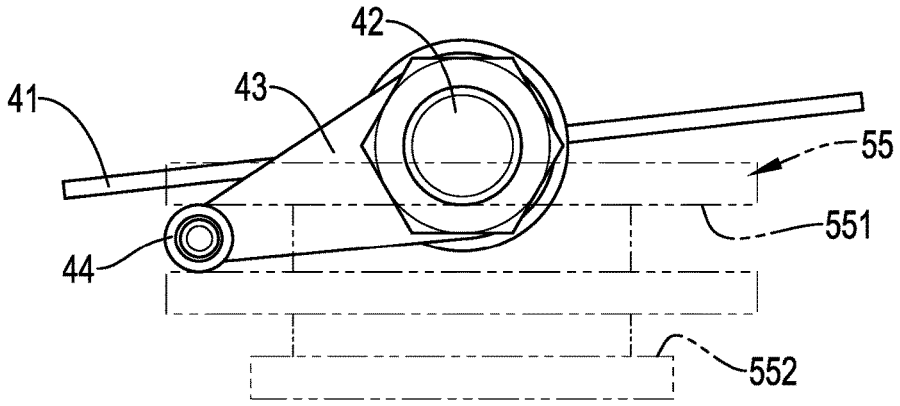
FIG. 6C is a side view of the blade assembly and the adjusting assembly in FIG. 1.

With further reference to FIG. 6C, the support 55 is mounted around the downrod 20, is coaxial with the downrod 20, is disposed above the outer tube 51 and the inner tube 53, and is movable up and down along the axial direction of the downrod 20. The support 55 has an outer side surface, a driving annular recess 551, and a transmission annular recess 552. The driving annular recess 551 is formed in the outer side surface of the support 55. The transmission annular recess 552 is formed in the outer side surface of the support 55 and is disposed below the driving annular recess 551. The driving rods 44 of the blade assemblies 40 are mounted in the driving annular recess 551 of the support 55 and are parallel to tangent lines of the driving annular recess 551.

The connecting panels 57 are mounted in the transmission annular recess 552 of the support 55. Each of the connecting panels 57 is arc-shaped and is securely connected to the connecting flange 531 of the inner tube 53 via at least one fastener 58. Thus, as the inner tube 53 moves up and down, the support 55 moves up and down accordingly.

The driving motor 56 is securely mounted in the hub 10, is disposed beside the bottom end of the outer tube 51, and has a driving screw 561. The driving screw 561 engages the ring gear 511 of the outer tube 51. Specifically, the driving motor 56 is securely mounted in the lower casing of the hub 10. Specifically, the driving motor 56 may be a servo motor that is used for controlling a rotating angle of the driving screw 561 and may be controlled by remote control.

Figure 7A:
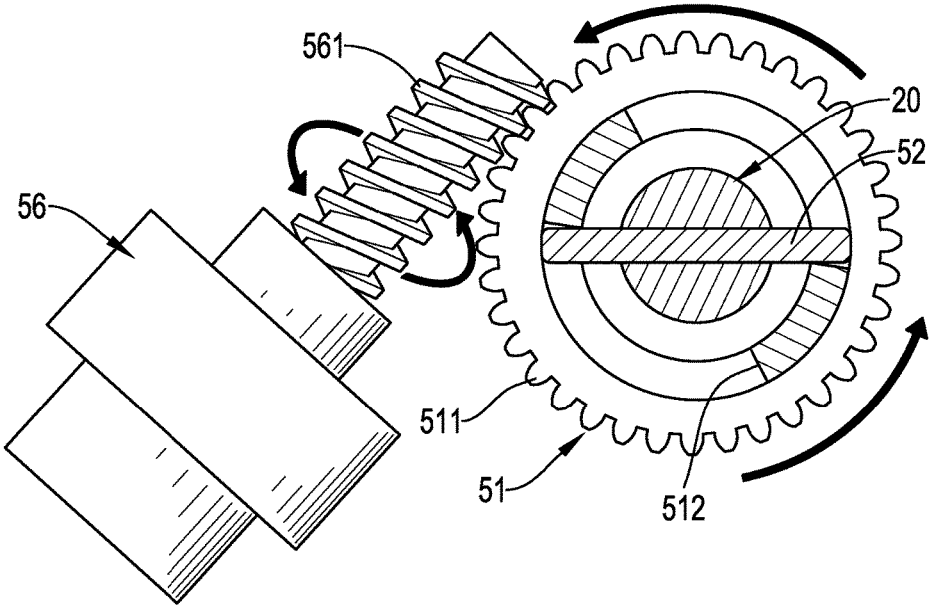
FIG. 7A is a cross-sectional operational top view of the downrod and the adjusting assembly of the ceiling fan in FIG. 1.
Figure 7B:
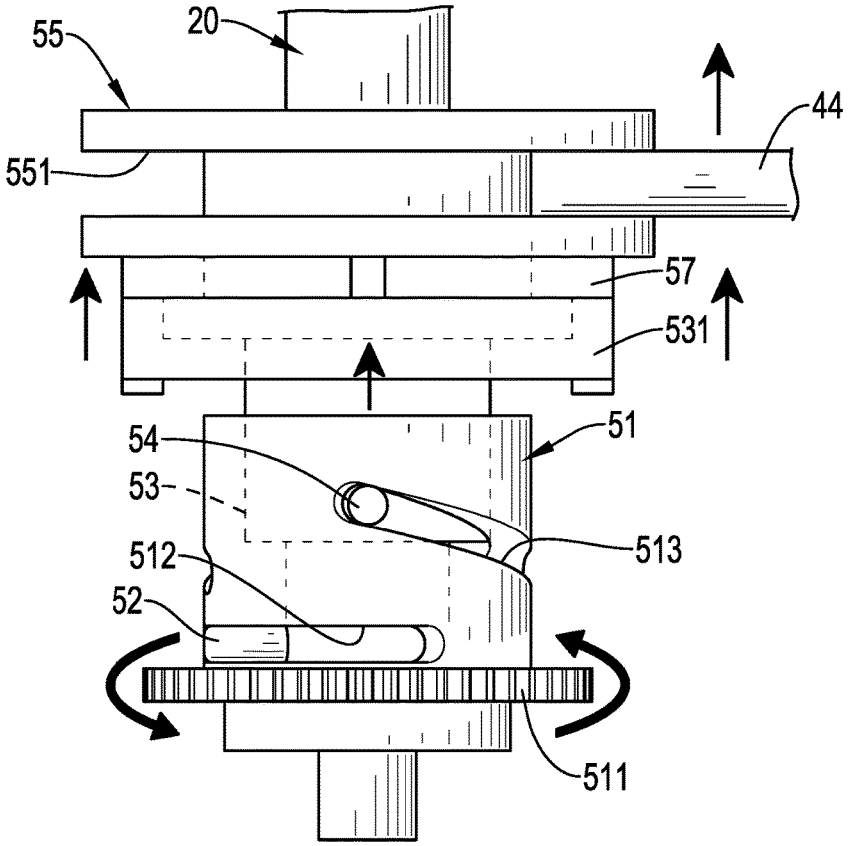
FIG. 7B is an enlarged operational side view of the downrod, the adjusting assembly, and the driving rod of the blade assembly of the ceiling fan in FIG. 1.

With further reference to FIGS. 7A and 7B, when the driving screw 561 of the driving motor 56 rotates, the driving screw 561 drives the outer tube 51 via the ring gear 511, such that the outer tube 51 rotates accordingly. As the outer tube 51 rotates, the at least one guiding rod 54 that is securely attached to the inner tube 53 slides along the at least one guiding slot 513 of the outer tube 51. When the at least one guiding rod 54 slides toward the lower end of the at least one guiding slot 513, the inner tube 53 moves downwardly relative to the downrod 20 and the outer tube 51. When the at least one guiding rod 54 slides toward the upper end of the at least one guiding slot 513, the inner tube 53 moves upwardly relative to the downrod 20 and the outer tube 51.

Figure 7C:
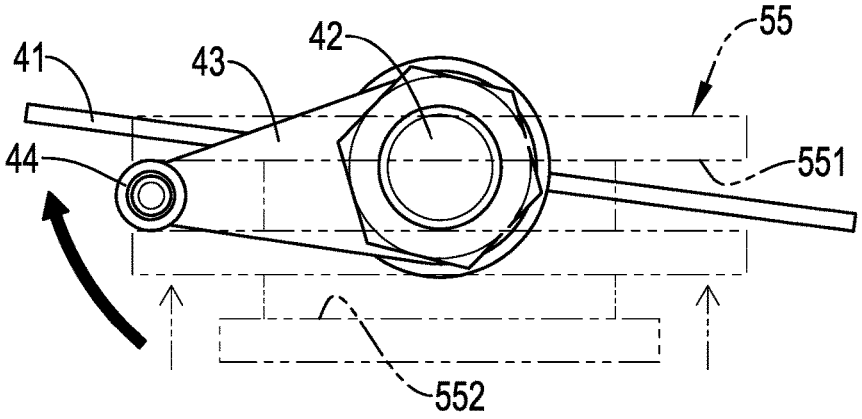
FIG. 7C is an operational side view of the blade assembly and the adjusting assembly in FIG. 1.

With further reference to FIGS. 7B and 7C, as the inner tube 53 moves upwardly and downwardly, the support 55 as well as the driving rods 44 of the blade assemblies 40 is driven to move upwardly and downwardly accordingly. Thus, the driving rods 44 drive the pivot shafts 42 and the fan blades 41 to rotate via the connectors 43.

The ceiling fan as described has the following advantages. A user may directly control the driving motor 56, for example, via the remote control, to adjust tilting angles of the fan blades 41, so as to allow the user to adjust volume of air current under a specific revolution speed of the rotating motor 30. Otherwise, the driving motor 56 of the adjusting assembly 50 may be electrically connected to the rotating motor 30 and started according to the rotating motor 30. When the revolution speed of the rotating motor 30 changes, the driving motor 56 is started to adjust the tilting angles of the fan blades 41, so as to provide an optimized volume of the air current that meets power saving requirement under a constant revolution speed of the rotating motor 30.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A ceiling fan comprising:

a hub being hollow and having a side panel;

a downrod vertically mounted through the hub along a rotation axis of the hub;

a rotating motor mounted in the hub, connected to the downrod and the hub, and selectively driving the hub to rotate relative to the downrod;

multiple blade assemblies separately mounted on and arranged around the side panel of the hub, each of the blade assemblies extending along a radial direction of the hub and including a fan blade having an inner end positioned toward the hub;

a pivot shaft securely attached to the inner end of the fan blade and rotatably mounted through the side panel of the hub, and the pivot shaft having an outer end protruding to an exterior of the hub and securely attached to the fan blade; and an inner end protruding to an interior of the hub;

a connector mounted in the hub and having a first end securely connected to the inner end of the pivot shaft; and a second end; and a driving rod mounted in the hub, rotatably connected to the second end of the connector, and being parallel to the connector; and an adjusting assembly mounted in the hub and including an outer tube rotatably mounted around the downrod and having an outer side surface;

a ring gear formed around the outer side surface of the outer tube;

at least one limiting slot formed through the outer tube, and each of the at least one limiting slot extending transversely; and at least one guiding slot formed through the outer tube, and each of the at least one guiding slot extending obliquely and having an upper end and a lower end;

at least one limiting rod, each of the at least one limiting rod disposed along a radial direction of the downrod, securely attached to the downrod, and having at least one limiting end, and each of the at least one limiting end protruding in a corresponding one of the at least one limiting slot;

an inner tube mounted around the downrod and disposed between the downrod and the outer tube;

at least one guiding rod disposed along the radial direction of the downrod and securely attached to the inner tube, and each of the at least one guiding rod protruding in a corresponding one of the at least one guiding slot;

a support mounted around the downrod, being coaxial with the downrod, disposed above the outer tube and the inner tube, and being movable up and down along an axial direction of the downrod, and the support having an outer side surface; and a driving annular recess formed in the outer side surface of the support;

wherein the driving rods of the blade assemblies are mounted in the driving annular recess of the support; and a driving motor securely mounted in the hub and having a driving screw, and the driving screw engaging the ring gear of the outer tube.

2. The ceiling fan as claimed in claim 1, wherein the inner tube has a top end; and a connecting flange formed around the top end of the inner tube and extending along a radial direction of the inner tube;

the support further has a transmission annular recess formed in the outer side surface of the support; and the adjusting assembly further includes multiple connecting panels mounted in the transmission annular recess of the support, and each of the connecting panels is securely connected to the connecting flange of the inner tube via at least one fastener.

3. The ceiling fan as claimed in claim 1, wherein the at least one limiting slot of the outer tube includes two limiting slots oppositely disposed on the outer tube;

the at least one guiding slot of the outer tube includes two guiding slots oppositely disposed on the outer tube;

the at least one limiting rod includes one limiting rod radially mounted through the downrod;

the at least one limiting end of the limiting rod includes two limiting ends respectively protruding in the two limiting slots; and the at least one guiding rod includes two guiding rods oppositely disposed on the downrod and respectively protruding in the two guiding slots of the outer tube.

4. The ceiling fan as claimed in claim 2, wherein the at least one limiting slot of the outer tube includes two limiting slots oppositely disposed on the outer tube;

the at least one guiding slot of the outer tube includes two guiding slots oppositely disposed on the outer tube;

the at least one limiting rod includes one limiting rod radially mounted through the downrod;

the at least one limiting end of the limiting rod includes two limiting ends respectively protruding in the two limiting slots; and the at least one guiding rod includes two guiding rods oppositely disposed on the downrod and respectively protruding in the two guiding slots of the outer tube.

5. The ceiling fan as claimed in claim 1, wherein the hub further has a top panel and a bottom panel; and the downrod is connected to the top panel and the bottom panel of the hub via rotating bearings.

6. The ceiling fan as claimed in claim 2, wherein the hub further has a top panel and a bottom panel; and the downrod is connected to the top panel and the bottom panel of the hub via rotating bearings.

7. The ceiling fan as claimed in claim 3, wherein the hub further has a top panel and a bottom panel; and the downrod is connected to the top panel and the bottom panel of the hub via rotating bearings.

8. The ceiling fan as claimed in claim 4, wherein the hub further has a top panel and a bottom panel; and the downrod is connected to the top panel and the bottom panel of the hub via rotating bearings.

9. The ceiling fan as claimed in claim 1, wherein the driving rods of the blade assemblies are parallel to tangent lines of the driving annular recess.

10. The ceiling fan as claimed in claim 2, wherein the driving rods of the blade assemblies are parallel to tangent lines of the driving annular recess.

11. The ceiling fan as claimed in claim 3, wherein the driving rods of the blade assemblies are parallel to tangent lines of the driving annular recess.

12. The ceiling fan as claimed in claim 4, wherein the driving rods of the blade assemblies are parallel to tangent lines of the driving annular recess.

* * * * *